US005104236A

United States Patent [19]

LaFleur

[11] Patent Number: 5,104,236

[45] Date of Patent: Apr. 14, 1992

[54] SCRAPLESS COLLAPSIBLE BAG WITH CIRCUMFERENTIALLY SPACED REINFORCED STRIPS

[75] Inventor: Lee LaFleur, Manistee, Mich.

[73] Assignee: Custom Packaging Systems, Inc., Manistee, Mich.

[21] Appl. No.: 669,907

[22] Filed: Mar. 15, 1991

[51] Int. Cl.[5] ..... B65D 30/06; B65D 30/20; B65D 33/02; B65D 33/14

[52] U.S. Cl. ..... 383/17; 383/22; 383/41; 383/67; 383/105; 383/107; 383/117; 383/202

[58] Field of Search ..... 383/17, 117, 18, 22, 383/41, 67, 105, 202, 107

[56] References Cited

U.S. PATENT DOCUMENTS

| | | | |
|---|---|---|---|
| 1,572,605 | 2/1976 | Howe | 383/117 |
| 3,105,617 | 10/1963 | Felldin | 383/41 |
| 4,597,102 | 6/1986 | Nattrass | 383/107 |
| 4,610,028 | 9/1986 | Nattrass | 383/117 |
| 4,658,432 | 4/1987 | Lehmann et al. | 383/117 |
| 4,703,517 | 10/1987 | Marino | 383/17 |
| 4,781,472 | 11/1988 | LaFleur et al. | 383/17 |
| 4,790,029 | 12/1988 | LaFleur et al. | 383/67 |

*Primary Examiner*—Stephen P. Garbe
*Attorney, Agent, or Firm*—Barnes, Kisselle, Raisch, Choate, Whittemore & Hulbert

[57] ABSTRACT

A reinforced collapsible bag and method of making it from blanks of a flexible woven material which are cut from an elongate web substantially without wasting any material between adjacent blanks with pairs of reinforced strips extending along the side edges and through the central portion of the sides and top and bottom of the bag, thereby reinforcing the bottom, top, sides and corners of the bag. Each blank has a circumferentially continuous central portion and four isosceles triangular portions at each end of the blank. Adjacent sides of adjacent triangular portons are connected together to provide, when the bag is exapnded or filled, generally square ends which are interconnected by generally rectangular side walls. Lifting sstraps can be attached to the reinforced strips along the side edges of the bag. An access opening is provided in an end of the bag by terminating the connections of its triangular portions short of their apexes. Preferably, a spout is received in the access opening and connected to the triangular portions.

13 Claims, 3 Drawing Sheets

FIG. 1
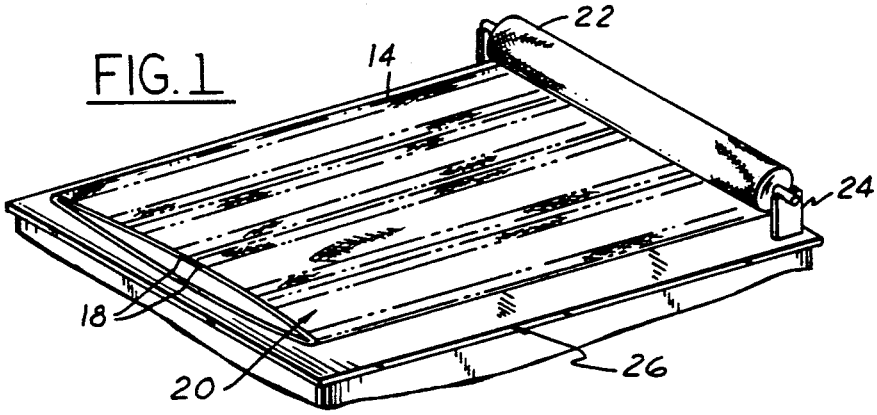
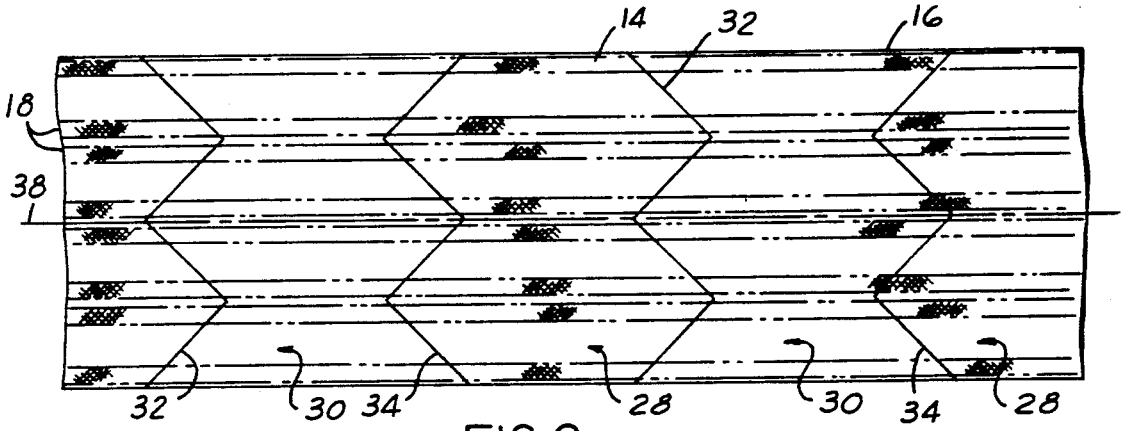
FIG. 2
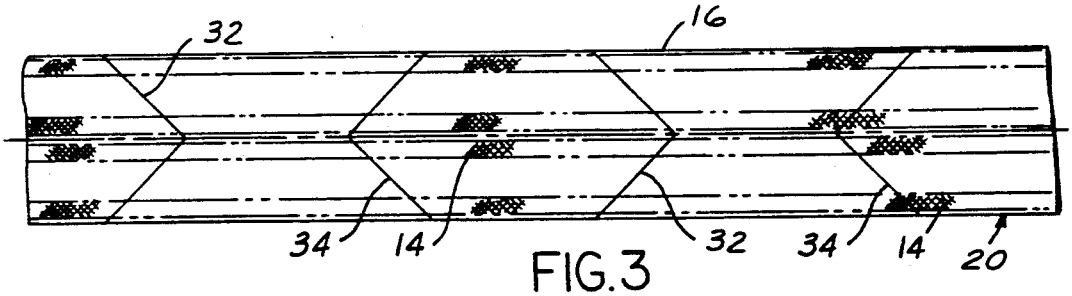
FIG. 3
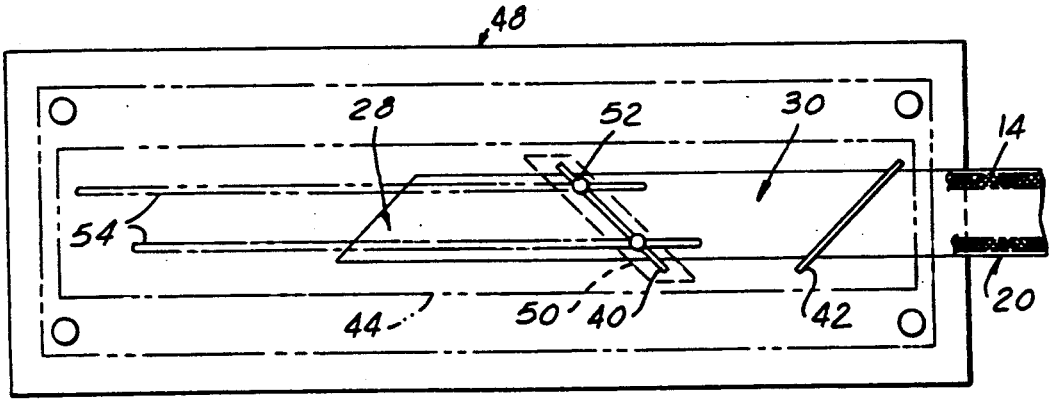
FIG. 4

SCRAPLESS COLLAPSIBLE BAG WITH CIRCUMFERENTIALLY SPACED REINFORCED STRIPS

FIELD OF THE INVENTION

This invention relates to shipping and storage containers, and more particularly to a reinforced collapsible container in the form of a bag of a flexible woven material and a method of making it.

BACKGROUND OF THE INVENTION

Previously, many granular products and some liquids have been shipped and stored in large bulk bags which may contain as much as a ton or more of material. Some of these bulk bags are flexible and when empty can be folded to a generally flat condition. One such flexible bag is disclosed and claimed in U.S. Pat. No. 4,790,029.

These flexible bags have generally rectangular ends interconnected by generally rectangular side walls and when filled can be stacked one on top of another. For some applications, preferably the bags are made of a woven fabric, and for other applications, a plastic material. For some applications, and particularly for storing liquids, a bag of a water impervious plastic material is received in and reinforced and protected by a bag of a woven fabric. Usually, these bags have a spout in one or both ends for filling and emptying the bags.

U.S. Pat. No. 4,362,199 discloses a bulk bag of woven fabric with lift straps attached to selected reinforced areas of the fabric. Each area is reinforced by a pluralilty of warp yarns of a higher tensile strength than the warp and weft yarns of the base fabric. The reinforced areas have a variety of spacings and configurations.

SUMMARY OF INVENTION

In accordance with this invention, reinforced collapsible bags are produced from a tubular blank of flexible material which has a plurality of laterally spaced apart reinforced areas or strips extending longitudinally throughout the tubular blank and each having a plurality of warp threads spaced closer together than the warp threads in the other areas of the fabric with all of the warp threads being of the same material and the same nominal tensile strength. Thus, the reinforced areas have a greater density of warp threads than the other or non-reinforced areas. These reinforced strips provide bands extending substantially around the entire periphery of the bag and through the central portion of the sides and ends, and strips adjacent the side edges of the bag for attachment of lift straps.

Preferably, the tubular blank has eight pairs of strips substantially equally spaced apart laterally about the circumference of the tubular blank. Preferably, the two strips of each pair are slightly laterally spaced apart to facilitate folding at both the side edges of the bag and the gussets of its side panels.

When filled, preferably the bags have substantially square ends interconnected by four generally rectangular side portions which are all part of the same blank of flexible material and when empty can be folded into a flat and compact arrangement having a pair of overlying panels of generally hexagonal configuration with a pair of folded gusseted panels received therebetween. Preferably, the collapsible bags are produced from an elongate web of flexible material to produce a plurality of substantially identical blanks with little if any waste material between adjacent blanks Each blank has a reinforced central portion and four generally triangular reinforced portions adjacent each end of the central portion and integral therewith. The sides of each triangular portion extend from the central portion toward the apex of the triangular portion The adjacent sides of adjacent triangles are connected together adjacent their edges along a line extending from the central portion at least one-third and usually at least one-half of the distance toward their associated apexes to provide, when the bag is filled, generally opposed reinforced ends having a substantially square configuration with four generally rectangular reinforced side panels extending therebetween.

To provide an access opening through an end at generally the center thereof, lines of connection of the triangular portions are terminated short of their apexes. When an access opening is provided in only one end of the bag, preferably the lines of connection of the triangular portions of the other end are extended substantially to their associated apexes to provide a permanently closed end without an access opening therethrough.

Preferably, a spout is provided for each opening. Preferably, each spout has a separate tubular piece of flexible material connected adjacent one end to the triangular portions associated with the opening along a line of connection which extends substantially and preferably completely around the periphery of the spout.

Objects, features and advantages of this invention are to provide a reinforced collapsible bag and method of making it which greatly reduces and substantially eliminates all wasted material, maximizes load bearing capacity while minimizing the quantity, weight and cost of the fabric material of the bag, produces highly accurate severing of blanks for bags and close dimensional control of bags, greatly simplifies and facilitates severing blanks for bags from a continuous web, is readily and easily adapted to the mass production of bags, and is of relatively simple, economical and reliable manufacture of bags.

BRIEF DESCRIPTION OF THE DRAWINGS

These and other objects, features and advantages of this invention will be apparent from the following detailed description, appended claims, and accompanying drawings in which:

FIG. 1 is a perspective view of a dispenser for and a roll of a continuous reinforced web of woven material for making a plurality of blanks for bags in accordance with this invention;

FIG. 2 is a fragmentary plan view of the reinforced web of woven material with severing lines thereon for cutting a plurality of blanks from the web in accordance with this invention;

FIG. 3 is a fragmentary plan view of the reinforced web of FIG. 2 after it has been folded once about its longitudinal axis to simplify cutting the blanks;

FIG. 4 is a fragmentary plan view of the blank of FIG. 3 after it has been folded twice to further simplify cutting blanks and received in a severing apparatus;

DETAILED DESCRIPTION

For applications where containers or bags of great strength are needed, they may be made from a woven fabric material with reinforcing strips, such as woven polyethylene and woven polypropylene fabrics. If a leak-proof and high-strength container is required, a bag of a plastic film can be received in a bag of a woven reinforced fabric with both bags having the same configuration.

Figure 13:
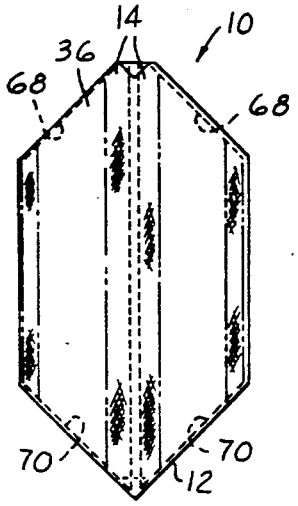
FIG. 13 is a plan view of a reinforced bag embodying this invention when collapsed.
Figure 14:
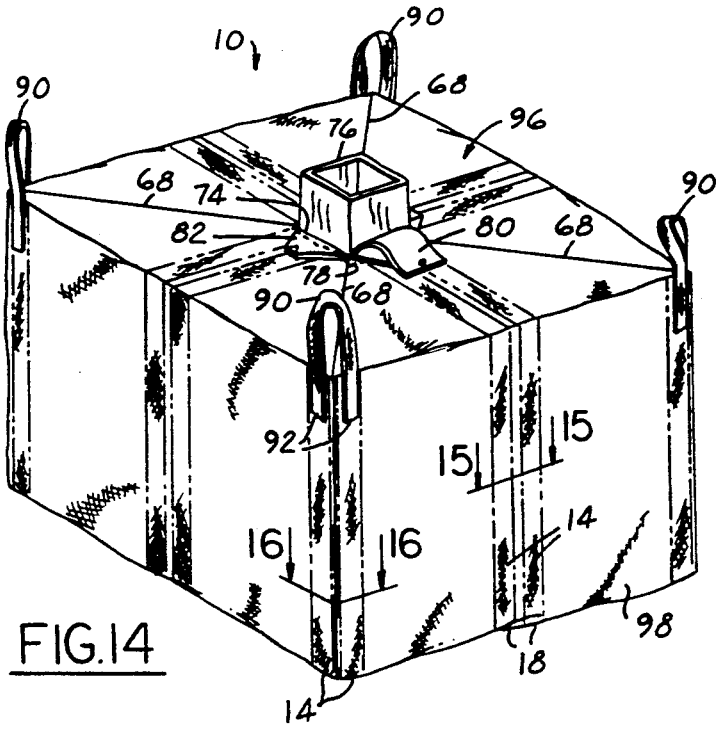
FIG. 14 is a perspective view of the reinforced bag of FIG. 13 when expanded and with its spout open.

In accordance with this invention, collapsible reinforced bags 10, as shown in FIGS. 13 and 14, are made from blanks 12 of a flexible woven material with reinforcing strips 14 extending longitudinally therein. As shown in FIG. 14, when expanded or filled, each bag has a generally cubical configuration with a pair of generally square ends 96 interconnected by four generally rectangular side walls 98. To facilitate folding when the bag is empty preferably a pair of the opposed side walls have gussets threin Each end has four triangular portions 36 integral with the side walls and having their side edges connected together to form the end. Preferably, the blanks are cut or severed from an elongate web 16 (FIGS. 1-3), of a flexible woven material with the reinforcing strips 14 therein.

Figure 16:
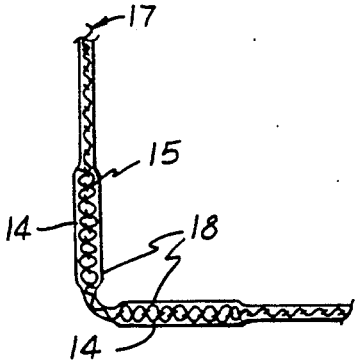
FIG. 16 is a fragmentary sectional view taken on line 16—16 of FIG. 14 illustrating the reinforcing strips at a side edge of the bag.
Figure 15:
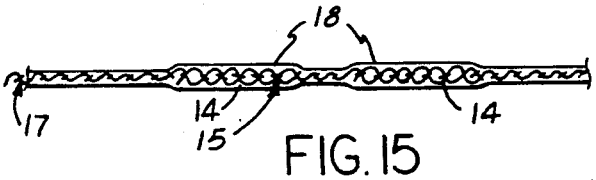
FIG. 15 is a fragmentary sectional view on line 15—15 of FIG. 14 illustrating the reinforcing strips in a side of the bag.

As shown in FIGS. 15-16, each strip 14 has a plurality of warp threads 15 spaced closer together than the warp threads in the other areas of the woven fabric. Each reinforced strip has a greater density of warp threads than the density of warp threads in the other or non-reinforced areas of the woven material. All of the warp threads are of the same material and have substantially the same nominal diameter and tensile strength. Preferably, all of the warp threads 15 and the weft threads 17 are of the same material and substantially the same nominal diameter and tensile strength.

Preferably, to provide reinforcing strips extending around substantially the entire periphery of the bag in the central portion of its sides and ends, and at the side edges of the bag, while permitting the blanks to be formed without any scrap material, each blank has eight pairs 18 of reinforcing strips 14. The eight pairs of reinforcing strips are laterally spaced apart substantially equally throughout the circumference of the blank. To facilitate folding of the fabric at the side edges and the gussets, preferably the two adjacent strips of each pair are laterally or circumferentially slightly spaced apart. Preferably, the two strips of each pair are spaced apart not more than about 1", usually less than ¾" and preferably about ¼" to ½". Desirably, each reinforced strip is about 2-½" to 3-½" wide and preferably about 3" wide.

Preferably, a plurality of substantially identical blanks are severed or cut from a web without wasting any material between adjacent blanks. The web contains a plurality of reinforced areas or strips woven therein which extend longitudinally of the web and are created by increasing the density of the warp threads by packing more warp threads into each reinforced area. Preferably, all of the warp threads for the entire fabric are of the same material, diameter and tensile strength. Each blank has a circumferential continuous central portion and four isosceles triangular portions at each end of the blank. Adjacent sides of adjacent triangular portions are connected together to provide, when the bag is expanded or filled, generally square ends which are interconnected by generally rectangular side walls. Reinforcing strips extend generally longitudinally of the web in pairs, adjacent each side edge of the bag with the two strips of each pair separated by non-reinforced material to facilitate folding the material. Pairs of reinforcing strips also extend longitudinally of the web between the apex of opposed triangular portions, thereby reinforcing the side walls and the continuous bottom and top triangular portions and the seams or joints therein.

Preferably, to provide square ends which are generally flat when the bag is filled, the triangular portions are substantially identical isosceles triangles each with a substantially 90° angle at its apex and a pair of substantially 45° acute angles. Each side wall has a width of about one-quarter of the circumference of the tubular blank and preferably each triangular portion has a height of about one-half of the width of a side wall or about ⅛ of the circumference of the tubular blank. If it is desirable when the bag is filled for the triangular portions of the square ends to provide a generally tapered or conical configuration, the included angle at the apex of opposed pairs of the isosceles triangles differs. For example, at each end the apex angles of one opposed pair of triangles could be 80° and of the other opposed pair of triangles 110°.

If desired, the blanks can be cut from an elongate sheet of a single layer of flexible material, and then their side edges connected or jointed together to provide a tubular blank. However, as shown in FIG. 1, preferably the blanks are cut from the tubular web 20 which is circumferentially continuous and incorporates the pairs of reinforced strips 18. Preferably, the tubular web is seamless, although it can be formed by connecting or joining together the sides on an elongate sheet of flexible material, such as by stitching a woven fabric or heat sealing a plastic woven sheet. Preferably, the web has a circumferentially continuous circular woven fabric with threads of a material such as polypropylene having about 20 to 25 and preferably 22 warp threads per lineal inch in the reinforced strips and about 14 to 8 and preferably 11 warp threads per lineal inch in the other areas of the bag. Preferably, the threads have a nominal diameter of about 3 to 6 and preferably 4.5 mils and the fabric has a nominal weight of about 6 to 9 and preferably about 7.5 ounces per square yard. Preferably, the reinforced areas have a tensile strength of at least about 550 pounds of force and the non-reinforced areas a tensile strength of about 300 pounds of force. The fabric can be either coated or uncoated. Suitable fabrics are commercially available from Fib-Pak, Inc., 1201 Spence Avenue, Hawkesbury, Ontario, Canada.

To facilitate handling the elongate web, preferably, it is in the form of a roll 22 which can be supported for rotation by yokes 24 on a work table 26. As shown in FIG. 2, a plurality of blanks 28 and 30 may be formed from the web 20, without any scrap, by cutting or severing the web along the zig zag lines 32 and 34 which extend around the periphery of the tubular web. To form four substantially identical isosceles triangular portions 36 on each end of each blank, each segment of the lines 32 and 34 is of the same length and inclined at an acute included angle of substantially 45° to the longitudinal axis 38 of the web. Adjacent segments of each of the lines 32 and 34 form an apex of a triangular portion and are at substantially a right angle to each other.

To simplify cutting the web and improve the accuracy of the cut blanks, it is desirable to fold the web once, as shown in FIG. 3, and preferably twice, as shown in FIG. 4. If a tubular web is folded over itself once, as shown in FIG. 3, it will have four layers of material which can be cut at the same time along the generally V-shaped segments of lines 32 and 34. If the tubular web is folded over itself twice, as shown in FIG. 4, there will be eight layers of material which can be cut at the same time along the straight segment of the lines 32 and 34.

As shown in FIG. 4, when the web has been folded twice, it can be readily severed or cut by straight knife edges 40 and 42 carried by a movable upper platen 44 of a fixture 46 received in a conventional press 48. To facilitate cutting blanks of various lengths, preferably the blade 40 is received in an adjustable holder 50 which can be moved longitudinally of the platen relative to the blade 42 and secured in a position to cut blanks of the desired length by the locking screws 52 received in slots 54 in the upper platen. The twice folded web 20 is advanced through the fixture a distance equal to twice the desired length of the blanks so that with each cycle of the press the knife edges cut two blanks from the web (one blank 28 and one blank 30).

Figure 11:
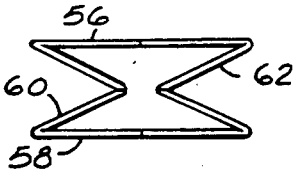
Figure 12:
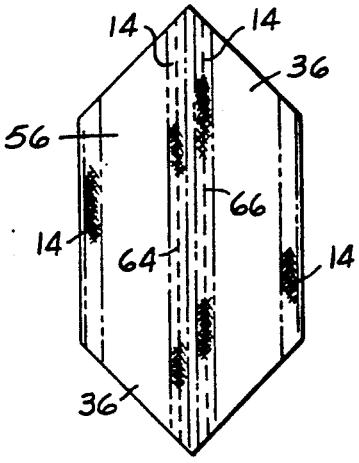
FIG. 12 illustrates a blank folded into a configuration having a pair of generally flat and overlying panels of generally hexagonal shape with a pair of folded gusseted panels received therebetween.

Preferably, although not necessarily, to facilitate connecting together adjacent side edges of adjacent triangular portions of the blanks to form the collapsible bag, the blanks 28 and 30 as cut from the web are rearranged and refolded into the generally collapsed configuration as shown in FIG. 12. The edge formed by the fold occurs along the gap between each pair of reinforced strips. In this collapsed configuration, each blank has a pair of generally flat overlying hexagonal shaped panels 56 and 58 with a pair of folded gusseted panels 60 and 62 (FIG. 11) received therebetween, with reinforced corners.

Figure 5:
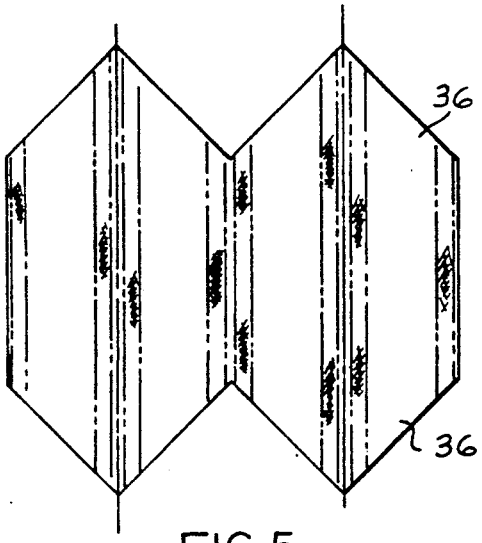
FIGS. 5 and 6 are plan views of adjacent substantially identical blanks as severed from the web.
Figure 6:
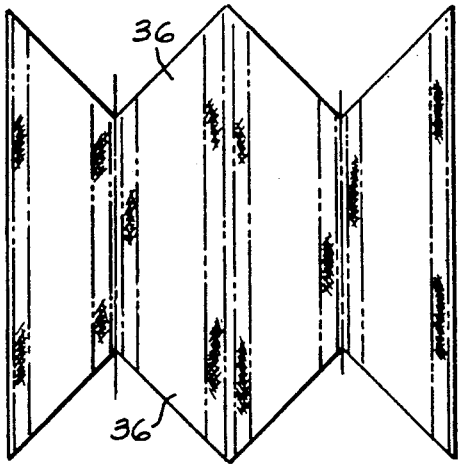
Figure 7:
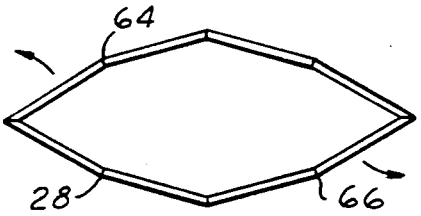
FIG. 7 is an end view of the blank of FIG. 5 as severed from the web.
Figure 8:
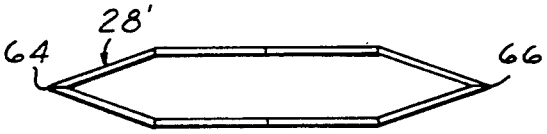
FIGS. 8 and 9 are end and plan views respectively of the blank of FIG. 5 after its material has been rotated circumferentially through an arc of about 45° so that it has the same orientation as the blank of FIG. 6.
Figure 9:
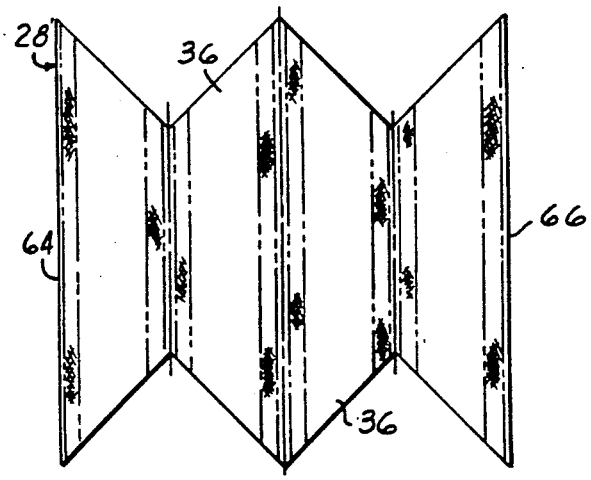

Preferably, the blanks 28 are first reoriented from the configuration shown in FIG. 5 to the configuration shown in FIG. 9. This is accomplished by circumferentially rotating the material of the tubular blank 28 through an arc of about 45° as shown by a comparison of FIGS. 5 and 7 with FIGS. 8 and 9, so that the reoriented blank 28' has two layers of material with folds along the lines 64 and 66, the location of which is indicated by phantom lines in FIG. 5. After the blank 28 has been so folded, it has the same configuration as that of the blank 30, with reinforcing strips in the same positions.

Figure 10:
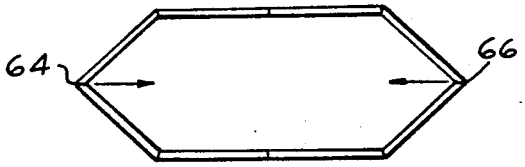
FIGS. 10 and 11 are end views illustrating folding of the blanks of FIGS. 6 and 9 into the configuration of FIG. 12.

Preferably, all the blanks 28' and 30 are refolded into the configuration of FIG. 12 to facilitate making the bags. As shown in FIGS. 10 and 11, the blanks are refolded by moving the fold lines 64 and 66 inwardly so they lie adjacent each other to thereby rearrange each blank so it has overlying hexagonal shaped panels 56 and 58 with gusseted panels 60 and 62 therebetween.

To provide generally square ends when the bag is expanded, the adjacent side edges of adjacent triangular portions 36 are jointed or connected together along the lines of connection 68 and 70 as shown in FIGS. 13 and 14. The pairs of reinforced strips extending to the apex of the adjacent triangular portions provide reinforcement to the square ends, when folded, strengthening the seams and spout connections of the bag. Since the bag is made of a woven fabric material, preferably the triangular portions are connected along the lines 68 and 70 by a series of stitches with a suitable thread and if the material is a woven plastic film, preferably by heat sealing the triangular portions together along the connecting lines.

An access opening 74 is provided in at least one end of the bag. Preferably, the access opening is formed by terminating the lines of connection 68 or 70 short of the apexes of their associated triangular portions which forms a rectangular and, if desired, substantially square opening adjacent the center of the end of the bag. The lines of connection extend at least one-third, usually at least one-half, and preferably at least three-fourths of the distance from the central portion to the apexes of their associated triangular portions. If desired, another access opening can also be formed in the other end of the bag by terminating the lines of connection short of the apexes of its associated triangular portions. If no opening is desired in an end of the bag, its lines of connection can be extended to substantially the apexes of their associated triangular portions.

Preferably, a spout 76 is provided in each access opening. Preferably, the spout is a separate circumferentially continuous tube of the same material as the blank of the bag. As shown in FIGS. 14, one end of the spout is inserted in the opening 74 and connected to the associated triangular portions along a generally rectangular line of connection 78, such as by a series of stitches. The spout can be closed off and secured by a cord tied around it.

If desired, the spout can be covered by a flap 80 of flexible material which is connected to one of the triangular portions adjacent an edge of the access opening, such as by stitches. If desired, a grommet can be provided in the flap to facilitate securing it. Sometimes, it is desirable to secure the flap in a position spaced from the spout so that it will not interfere with material flowing out of the spout when emptying the bag. If desired, flaps for covering the opening 74 can be provided by the parts 82 of the triangular portions extending beyond their lines of connection. Preferably, to facilitate securing these flaps, they are provided with grommets adjacent their apexes through which a cord can be laced and tied.

Figure 17:
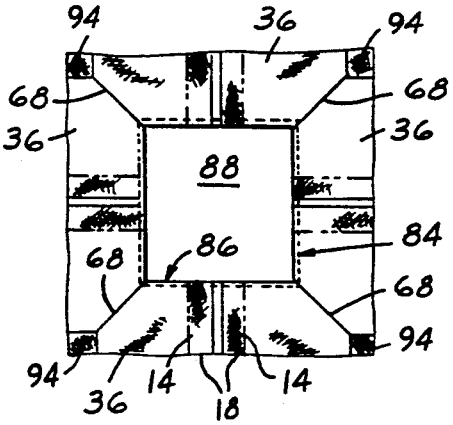
FIG. 17 is a bottom view of a modification of the bag of FIGS. 13 & 14.

If a bag with a spout in only the top is intended to be used only once and then disposed of, it may be preferable to provide an insert in the central portion of the bottom which can be easily pierced to remove the contents of the bag. As shown in FIG. 17, in the bottom of the bag the triangular portions 36 can be connected together, such as by stitches 68, throughout only a portion of the adjacent side edges to provide a generally rectangular central opening 86 through the bottom of the bag. This opening can be covered by a piece of woven fabric 88 attached to the bottom of the bag, such as by stitching 84 extending around the periphery of the opening. To facilitate piercing this piece of fabric, it should have less strength than the reinforcing strips. Preferably, the strength of this fabric is comparable to the non-reinforced areas of the bag. In use, to empty the filled bag, the fabric 88 is pierced and the contents flow out through the opening.

As shown in FIGS. 14 and 17, the top and bottom of the bag is also reinforced at the corners 94 by the adjacent strips 14 extending at a right angle to their associated edges and being connected together along the lines of connection of adjacent triangular portions such as by stitches. Similarly, the central portion of the top and bottom is also reinforced by the center strips 14, particularly if the bottom has no opening therein and the lines of connection of the adjacent triangular portions extend to the apexes of the triangles. Moreover, since the reinforced strips are adjacent the ends of each line of connection, they tend to decrease the tendency of the material when stitched to zipper or tear along the stitches when subjected to a large load.

If desired, loops 90 can be provided for lifting and moving the bag. Preferably, each loop is in the form of a strap of a flexible material with its runs 92 connected to the sides of the bag adjacent a side edge and the top of the bag and overlying the adjacent reinforced strips. Each run of each strap is connected to an underlying reinforced strip 14 of the bag, such as by a series of stitches, which greatly enhances the load carrying capacity of the loop.

As shown in FIG. 14, when the bag is filled, it assumes a generally rectangular or cubical configuration with generally square ends 96 formed by the triangular portions 36 and four interconnecting side walls 98 each of which is generally rectangular with a pair of reinforced strips 18 extending along each side edge, as shown in FIG. 16, and a pair of reinforcing strips 18 extending through the mid portion of the sides and ends and around substantially the periphery of the bag, as shown in FIG. 17. This provides a filled bag which can be stacked, and one which is strategically reinforced thereby providing optimal use of the woven material of the bag. When the bag is empty, it can be collapsed and folded into the generally flat configuration, shown in FIG. 11 and 13, with a pair of overlying generally hexagonal shaped panels 56 and 58 with folded gusseted panels 60 and 62 received therebetween. This provides a generally flat and compact configuration for shipment and storage of the bag when empty.

I claim:

1. A reinforced collapsible bag which when filled has a pair of spaced apart ends each being generally square with side wall portions extending therebetween, which comprises; a tubular blank of one piece of reinforced flexible woven material with longitudinal pairs of reinforced strips woven therein extending along the tubular blank, the blank having a circumferentially continuous central portion and four isosceles triangular portions adjacent each end, pairs of reinforced strips extending from the apex of each triangle through the blank to the apex of the opposed triangle of the other end of the blank, and pairs of strips extending from the juncture between each two adjacent triangular portions at one end of the blank through the central portion of the blank to the opposed juncture between two adjacent triangular portions at the other end of the blank, each of the triangular portions having a pair of sides extending from the central portion toward an apex of the triangular portion, connector means connecting together adjacent sides of adjacent trianglar portions adjacent their edges along lines of connection extending from at least closely adjacent the central portion toward their associated apexes at least half of the distance therebetween, and the lines of connection associated with the triangular portions adjacent at least one end of the central portion terminating short of their apexes so as to at least in part define an access opening therethrough adjacent the center of the generally square end defined by such triangular portions when such bag is expanded such that when filled such bag has a pair of spaced apart and substantially square ends interconnected by four generally rectangular side walls with a pair of reinforced strips extending generally along each side edge of the bag and a pair of reinforced strips extending substantially around the periphery of the bag through the central portions of the sides and ends of the bag, and when empty can be collapsed into a compact configuration having a pair of overlying panels with a pair of folded gusseted panels received therebetween with the fold line between adjacent gusseted panels extending between substantially the apexes of their associated opposed triangular portions and the fold lines lying closely adjacent each other, whereby the bag is reinforced by the reinforced strips.

2. The reinforced collapsible bag of claim 1 which also comprises a tubular spout which is circumferentially continuous and a separate piece of flexible material, said spout being disposed in such central access opening with an end portion of each triangular portion defining such central access opening overlapping said spout, and connector means connecting said tubular spout to said triangular portion at least substantially around the periphery of said spout.

3. The reinforced collapsible bag of claim 1 wherein at the other end of said blank each line of connection of adjacent sides of adjacent triangular portions extends substantially to their apexes so as to provide a completely closed other end of the bag of said blank.

4. The reinforced collapsible bag of claim 1 which also comprises a flap of a flexible material constructed and arranged to removably overlie the central opening in which said spout is disposed and at least in part to overlie at least a portion of at least one of the triangular portions, and connector means connecting said flap to said one triangular portion.

5. The reinforced collapsible bag of claim 1 which also comprises at least two straps of a flexible material each forming a lifting loop having a pair of runs, both runs of each strap being connected to the central portion of said blank with each run overlying one of the two strips of a pair of strips adjacent a side edge of the bag, and said loops being adjacent diagonally opposed corners of one of the generally square ends formed by the triangular portions of said blank.

6. The reinforced collapsible bag of claim 1 which also comprises four straps each of a separate piece of flexible material forming a lifting loop having a pair of runs, both runs of each strap being connected to the central portion of said blank with each run overlying one of two strips of a pair of strips adjacent one side edge of the bag, so as to provide a lifting loop adjacent each of the four corners of one of the generally square ends formed by the triangular portions of said blank.

7. The reinforced collapsible bag of claim 1 wherein such flexible material is a coated reinforced fabric weave material, and such connections comprise heat seals extending along such lines of connection

8. The reinforced collapsible bag of claim 1 wherein such flexible material is a reinforced fabric weave material and such connections comprise a series of stitches of thread extending along such lines of connection.

9. The reinforced collapsible bag of claim 1 wherein such flexible material is a woven fabric material and each of said reinforced strips comprises a plurality of warp threads spaced closer together than the warp threads of the non-reinforced areas of the woven fabric and all of the warp threads are of the same material and have substantially the same nominal tensile strength.

10. The reinforced collapsible bag of claim 9 wherein the pairs of reinforcing strips extending substantially around the periphery of the bag through the central portions of the sides connected together adjacent the apex of their associated triangular portions at one end of the bag.

11. The reinforced collapsible bag of claim 1 wherein the threads of such flexible woven material are of a plastic material.

12. The reinforced collapsible bag of claim 1 wherein the reinforcing strips adjacent the side edges extend into the ends of the bag and are connected together to form a proximately located corner reinforcement strengthening both the corner of the bag and the connection of their associated triangular portions.

13. The reinforced collapsible bag of claim 1 wherein the lines of connection of the triangular portions adjacent the other end of the central portion terminate short of their apexes to at least in part define an outlet opening through the bag, a piece of fabric covering such outlet opening and connected to such triangular portions around the periphery of such outlet opening, and said piece of fabric having less strength than the reinforcing strips to facilitate piercing thereof to discharge the contents of the bag through such outlet opening.

* * * * *